United States Patent [19]

Weinle et al.

[11] Patent Number: 4,733,545

[45] Date of Patent: Mar. 29, 1988

[54] RAVEL RESISTANT WARP KNIT ELASTIC TAPE AND METHOD

[75] Inventors: Paul L. Weinle, Charlotte; Ivan E. Hinshaw, Badin, both of N.C.

[73] Assignee: Collins & Aikman Corporation, New York, N.Y.

[21] Appl. No.: 58,143

[22] Filed: Jun. 4, 1987

[51] Int. Cl.[4] ..... D04B 7/16

[52] U.S. Cl. ..... 66/202; 66/193

[58] Field of Search ..... 66/202, 192, 193, 169, 66/170

[56] References Cited

U.S. PATENT DOCUMENTS

| | | | |
|---|---|---|---|
| 2,811,029 | 10/1957 | Conner | 66/202 X |
| 3,578,546 | 5/1971 | Morancy . | |
| 3,611,755 | 10/1971 | Millar . | |
| 3,999,407 | 12/1976 | Odham . | |
| 4,003,224 | 1/1977 | Odham . | |
| 4,009,597 | 3/1977 | Wall et al. . | |
| 4,133,191 | 1/1979 | Blore et al. . | |
| 4,248,064 | 2/1981 | Odham . | |
| 4,320,634 | 3/1982 | Hashimoto et al. . | |
| 4,323,061 | 4/1982 | Usukura | 66/202 UX |
| 4,372,998 | 2/1983 | Shimada . | |

*Primary Examiner*—Ronald Feldbaum

*Attorney, Agent, or Firm*—Bell, Seltzer, Park & Gibson

[57] ABSTRACT

Ravel resistance is provided in the present warp knit elastic tape by incorporating a thermoplastic heat fusible binder yarn extending back and forth across the width of the elastic tape and in courses of stitch loops forming walewise extending stitch loop chains in the elastic tape. The elastic tape is then heated so that the thermoplastic heat fusible binder yarn softens and fuses to the remaining yarns in the elastic tape to prevent unraveling of the stitch loop chains across the entire width of the elastic tape.

12 Claims, 3 Drawing Figures

RAVEL RESISTANT WARP KNIT ELASTIC TAPE AND METHOD

FIELD OF THE INVENTION

This invention relates generally to a ravel resistant warp knit elastic tape and method of forming same, and more particularly to such a tape which includes a thermoplastic heat fusible binder yarn in plated relationship with the filling yarns and extending back and forth across the elastic tape between opposite edges thereof, the binder yarn being fused to the yarns forming the stitch loop chains to prevent unraveling of the stitch loop chains across the entire width of the elastic tape.

BACKGROUND OF THE INVENTION

Various types of garments and clothing utilize knit elastic tapes, particularly waistbands of the type used in the manufacture of men's and ladies' underwear, pantyhose and the like. The conventional type of knit elastic tape has a tendency to ravel along its exposed edge after the garment has been worn and laundered over a period of time because the yarn forming the stitch loop chains along the selvage edges become worn or broken. In order to prevent raveling of the stitch chain loops along the opposite selvage edges of the knit elastic tape, it has been proposed that additional yarns be incorporated in the selvage edge stitch loop chains to prevent raveling thereof.

Examples of the use of such additional yarns in the stitch loop chains along opposite selvage edges of the elastic tape are disclosed in U.S. Pat. Nos. 4,003,224; 4,009,597; and 4,248,064. However, the interknitting of the additional yarn in the outermost stitch loop chains, as disclosed in these patents, tends to add thickness to the opposite side edges of the elastic tape and can also change the stretchable characteristics of the outer edge portions of the elastic tape. More importantly, the addition of the locking yarn in the stitch loop chains along the selvage edges of the tape does not prevent raveling of the stitch loop chains extending throughout the medial portion of the elastic tape. While these medial stitch loop chains are not subjected to the wear that the outer stitch loop chains are subjected to, the medial stitch loop chains are also subject to raveling since the tape is usually transversely cut and attached either to itself and/or to the garment by a coursewise extending row of stitches and in some instances, the stitching causes or breaks the yarn forming the stitch loop chains so that they are free to ravel. Also, the coursewise row of stitches does not always sufficiently bond or bind the yarns forming the medial stitch loop chains so that they ravel.

SUMMARY OF THE INVENTION

With the foregoing in mind, it is an object of the present invention to provide a ravel resistant warp knit elastic tape and method of forming the same in which the stitch loop chains extending entirely across the width of the elastic tape are highly resistant to raveling.

In accordance with the present invention, the elastic tape includes a plurality of parallel and walewise extending stitch loop chains. An elastomeric yarn is inlaid in and extends along the parallel stitch loop chains to provide longitudinal stretchability to the elastic tape. Filling yarn extends back and forth across the elastic tape and is held in the stitch loop chains. A thermoplastic heat fusible binder yarn is positioned to extend back and forth in plated relationship with the filling yarn so that upon application of heat to the elastic tape the heat fusible binder yarn softens and fuses to the yarns forming the stitch loop chains to prevent raveling of the stitch loop chains across the entire width of the elastic tape.

BRIEF DESCRIPTION OF THE DRAWINGS

Other objects and advantages will appear as the description proceeds when taken in connection with the accompanying drawings, in which.

DESCRIPTION OF THE ILLUSTRATED EMBODIMENT

The elastic tape, broadly indicated at 10, is illustrated and described as being a relatively narrow tape of the type normally employed as the waistband of various types of garments. However, it is to be understood that the present invention is not limited to use with narrow elastic tape but may be utilized with other types of knit elastic tapes which may be relatively wide and useful for various purposes, such as forming elastic panels in girdles, forming surgical body binders and the like.

Figure 1:
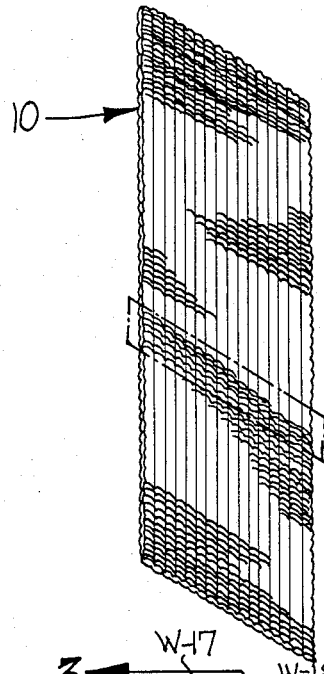
FIG. 1 is a fragmentary isometric view of a short length of the elastic tape of the present invention.
Figure 2:
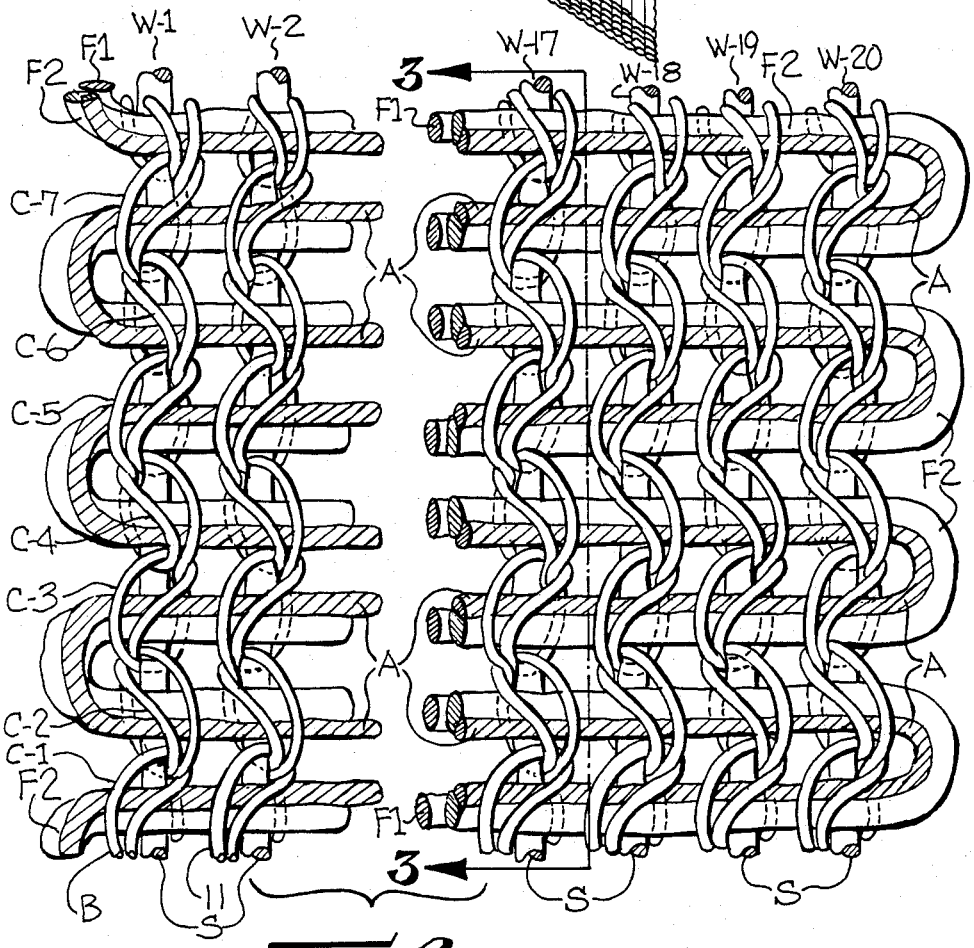
FIG. 2 is a greatly enlarged elevational view of the portion of the tape within the dash-dot line rectangle 2 in FIG. 1 and with the central portion being broken away.

As best illustrated in FIG. 2, the elastic tape, broadly indicated at 10, includes a plurality of parallel stitch loop chains 11 extending walewise in respective wales W-1 through W-20 (with the medial wales W-3 through W-16 broken away). The stitch chains 11 are knit of yarns B and form successive courses, as illustrated at C-1 through C-7, extending perpendicular to the wales of the elastic tape 10 and providing longitudinal stretchability to the elastic tape. The warp yarns B may be considered as body yarns and are usually formed of synthetic extruded material, such as multifilament polyester, are textured to impart stretchability thereto, and are in the range of about 70 to 300 denier, preferably about 150 denier.

Elastomeric warp yarns S are inlaid in and extend along selected ones of the parallel stitch loop chains 11 and provide longitudinal stretchability to the elastic tape 10. While the elastomeric yarns S are illustrated in FIG. 2 as being positioned in every stitch loop chain 11, it is to be understood that the elastomeric yarn S may be positioned in only spaced-apart stitch loop chains 11, if desired. The elastomeric yarn S may be of any suitable natural or synthetic material, such as rubber, elastomer or spandex, and are preferably laid in the tape in uncovered or raw condition. The elastomeric yarn S is within the range of about 140 to 3,600 denier, preferably about 1,600 denier.

Figure 3:
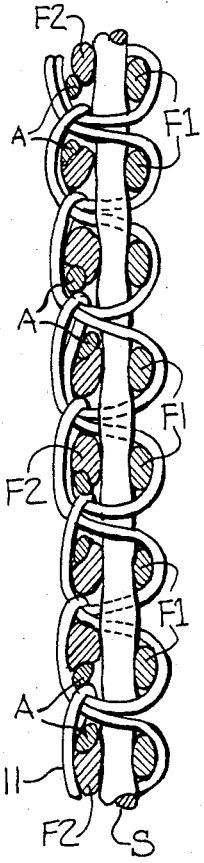
FIG. 3 is a vertical sectional view taken substantially along the line 3—3 in FIG. 2 and showing the manner in which the heat fusible binder yarn is plated with one of the filling yarns.

First and second filling yarns F-1 and F-2 extend back and forth across the elastic tape 10 and are held in the stitch loop chains 11 and on opposite sides of the inlaid elastomeric warp yarns S, as illustrated in FIG. 3. The first and second filling yarns F-1 and F-2 are heat resistant and are substantially larger than the body yarn B. The filling yarns F-1 and F-2 are preferably crimped to provide bulk but are substantially unstretchable and may be formed of any suitable synthetic material, such as conventional multifilament polyester, usually within the range of 450 to 1,350 denier. It is preferred that the filling yarns F-1 and F-2 each be formed of six ends of 150 denier so that each yarn is 900 denier.

A thermoplastic heat fusible binder yarn A is fed in plated relationship with the filling yarn F-2 and extends back and forth across the elastic tape 10 and between opposite selvage edges thereof. The thermoplastic heat fusible binder yarn A is striped in FIG. 2 and is illustrated in plated relationship with the filling yarn F-2 and on the face side of the elastic tape relative to the filling yarn F-2 and the elastomeric yarn S. The binder yarn A is thus in direct contact with the body yarns B forming the stitch loop chains 11, so that the binder yarn A can be fused to the stitch loops of the body yarn B, in a manner to be presently described. However, it is to be understood that the thermoplastic heat fusible binder yarn A could be fed in plated relationship with the other filling yarn F-1, or the binder yarn A could be fed in plated relationship with both of the filling yarns F-1 and F-2, if desired.

The thermoplastic heat fusible binder yarn A may be of any one of several different types of heat fusible yarns commercially available and which soften and fuse to the other yarns in the elastic tape at a lower temperature, usually in the range of from about 200° to 300° F. The size of the heat fusible binder yarn A is selected to provide the desired amount of ravel resistance to the elastic tape 10. The heat fusible binder yarn A is illustrated in FIGS. 2 and 3 as being of a much smaller diameter or denier than the filling yarns F-1 and F-2. The heat fusible binder yarn A is preferably about one-sixth to one-half the size of the filling yarns F-1 and F-2 and in the range of about 70 to 400 denier. The heat fusible binder yarn A may be of the polyethylene type or a copolyamide, having a fusing or melting range of about 230° to 248° F.

After the elastic tape 10 has been knit, in the manner illustrated in FIGS. 2 and 3, heat is applied to the elastic tape 10 so that the heat fusible binder yarn A softens and fuses to the yarns B forming the stitch loop chains 11, the filling yarns F-1 and F-2, and the elastomeric warp yarns S to prevent unraveling of the stitch loop chains 11 across the entire width of the elastic tape 10. The elastic tape 10 can be heated by any suitable means to cause the heat fusible binder yarn A to soften and fuse to the adjacent yarns, such as by running the elastic tape over heated cans or rolls. Alternatively, the elastic tape 10 may be heated on the knitting machine and during its path of travel to the take-up mechanism.

The elastic tape 10 of the present invention may be knit on any one of several different types of currently available warp knitting machines particulary adapted for knitting elastic tape without requiring any substantial modification of the knitting machine. For example, the filling yarns F-1 and F-2 are normally guided to the needles by yarn guide tubes which reciprocate back and forth across the width of the elastic tape 10 following each knitting stroke of the knitting machine. The heat fusible binder yarn A is incorporated in the elastic tape by simply feeding this heat fusible binder yarn A through the same yarn guide tube as the filling yarn F-2 is fed, and while guiding the binder yarn A so that it is plated to the face side of the elastic tape, as illustrated in FIG. 2. One such typical elastic tape warp knitting machine is schematically illustrated in U.S. Pat. No. 4,009,597 and reference may be made to this patent for a specific illustration of the manner in which the elastic tape is knit on the machine.

As a specific, but nonlimiting example, it has been found that a satisfactory $1\frac{1}{4}''$ wide elastic tape is provided when the body yarn B forming the parallel stitch loop chains 11 is a synthetic textured multifilament polyester yarn of 150 denier, the elastomeric inlay yarn S is uncovered and is 1,600 denier spandex, the filling yarn F-1 is formed of six ends of 150 denier textured multifilament polyester (total of 900 denier) while the filling yarn F-2 is formed of five ends of 150 denier textured multifilament polyester (total of 750 denier), and the thermoplastic heat fusible binder yarn A is a copolymer of nylon 6-12 of 150 denier. Since the 150 denier binder yarn A is plated with the five ends of 150 denier filling yarn F-2, both filling yarns F-1 and F-2 are of the same size, 900 denier.

After the elastic tape 10 is knit, in the manner illustrated in FIG. 2, the tape is passed over and in contact with a series of steam heated drying cans to soften and fuse the binder yarns A to the body yarns B forming the stitch loop chains 11. The elastic tape 10 is heated to a temperature range of 270° to 280° F. and the dwell time over the heated cans is about 5.2 minutes.

It is important that the proper amount of the thermoplastic heat fusible binder yarn A be incorporated in the elastic tape 10 to provide the desired amount of ravel resistance to the elastic tape 10. In the specific example provided, the thermoplastic heat fusible binder yarn A is approximately the same size or denier as the body yarn B, and is approximately one-sixth as large as the filling yarns F-1 and F-2. By varying the size of the thermoplastic heat fusible binder yarn A, relative to the other yarns in the elastic tape 10, it is possible to increase or decrease the ravel resistant characteristics of the elastic tape.

The thermoplastic heat fusible binder yarn A extending back and forth across the entire width of elastic tape 10 thus serves to prevent raveling of the stitch loop chains 11 when the elastic tape is heated a sufficient amount to soften and fuse the heat fusible binder yarn A to the other yarns forming the elastic tape. Also, the ravel resistant warp knit elastic tape 10 of the present invention may be knit on conventional warp knitting machines and requires very little modification thereof. The addition of the thermoplastic heat fusible binder yarn A does not add significantly to the cost of producing the elastic tape 10 and aids in preventing unraveling of the stitch loop chains across the entire width of the elastic tape.

In the drawings and specification there has been set forth the best mode presently contemplated for the practice of the present invention, and although specific terms are employed, they are used in a generic and descriptive sense only and not for purposes of limitation, the scope of the invention being defined in the claims.

That which is claimed is:

1. A ravel resistant warp knit elastic tape including (a) yarns forming a plurality of parallel and walewise extending knit stitch loop chains forming successive courses perpendicular to the wales of said elastic tape, (b) an elastomeric yarn inlaid in and extending along selected ones of said parallel stitch loop chains and providing longitudinal stretchability to said elastic tape, (c) filling yarn extending back and forth across said elastic tape and being held in said stitch loop chains, and (d) a thermoplastic heat fusible binder yarn extending alongside said filling yarn and being positioned against said stitch loop chains of successive courses and being fused thereto to prevent unraveling of said stitch loop chains across the entire width of the elastic tape.

2. A ravel resistant warp knit elastic tape according to claim 1 wherein said elastomeric yarn is inlaid in every parallel stitch loop chain across the width of said elastic tape.

3. A ravel resistant warp knit elastic tape according to claim 1 wherein first and second filling yarns extend back and forth across said elastic tape and are positioned on opposite sides of said elastomeric inlaid yarns, and wherein said thermoplastic heat fusible binder yarn is positioned in plated relationship with one of said first and second filling yarns.

4. A ravel resistant warp knit elastic tape according to claim 3 wherein said second filling yarn is positioned on the face side of said elastic tape and wherein said thermoplastic heat fusible binder yarn is in plated relationship with and on the outside of said second filling yarn.

5. A ravel resistant warp knit elastic tape according to claim 1 wherein said yarns forming said stitch loop chains are in the range of about 70 to 300 denier.

6. A ravel resistant warp knit elastic tape according to claim 1 wherein said elastomeric inlaid yarn is uncovered and in the range of about 140 to 3,600 denier.

7. A ravel resistant warp knit elastic tape according to claim 1 wherein said filling yarn is in the range of about 450 to 1,350 denier.

8. A ravel resistant warp knit elastic tape according to claim 1 wherein said thermoplastic heat fusible binder yarn is in the range of about 70 to 400 denier.

9. A thermoplastic heat fusible binder yarn according to claim 8 wherein said thermoplastic heat fusible binder yarn softens and fuses within the range of about 200° to 300° F.

10. A ravel resistant warp knit elastic tape including (a) a plurality of parallel and walewise extending stitch loop chains knit of body yarns and forming successive courses perpendicular to the wales of said elastic tape, (b) an elastomeric yarn inlaid in and extending along selected ones of said parallel stitch loop chains and providing longitudinal stretchability to said elastic tape, (c) a first filling yarn extending back and forth across said elastic tape between opposite selvage edges thereof and being held in said stitch loop chains, said filling yarn being positioned behind said elastomeric inlaid yarn, (d) a second filling yarn extending back and forth across said elastic tape between opposite selvage edges thereof and being held in said stitch loop chains, said second filling yarn being positioned in front of said elastomeric inlaid yarn, and (e) a thermoplastic heat fusible binder yarn extending alongside said second filling yarn back and forth across said elastic tape between opposite selvage edges thereof, said thermoplastic heat fusible binder yarn being positioned on the outside of said second filling yarn and against said stitch loop chains of successive courses and being fused to the yarns forming said stitch loop chains to prevent unraveling of said stitch loop chains across the entire width of the elastic tape.

11. A ravel resistant warp knit elastic tape according to claim 10 wherein said yarns forming said stitch loop chains are in the range of about 70 to 300 denier, wherein said filling yarns are in the range of about 450 to 1,350 denier, and wherein said thermoplastic heat fusible binder yarn is in the range of about 70 to 400 denier.

12. A ravel resistant warp knit elastic tape according to claim 11 wherein the yarns forming said stitch loop chains are about 150 denier, wherein said first filling yarn is about 900 denier, and said second filling yarn is about 750 denier, and wherein said thermoplastic heat fusible binder yarn is about 150 denier.

* * * * *